US006033750A

United States Patent [19]

Aladimi

[11] Patent Number: 6,033,750

[45] Date of Patent: Mar. 7, 2000

[54] STAINED GLASS WINDOW DESIGN

[76] Inventor: Ali Aladimi, P.O. Box 340234, Dayton, Ohio 45434

[21] Appl. No.: 09/070,564

[22] Filed: Apr. 30, 1998

[51] Int. Cl.[7] ..... B44F 1/06

[52] U.S. Cl. ..... 428/38; 52/204.59

[58] Field of Search ..... 428/38; 51/311.3, 51/311.2, 311.1, 204.59

*Primary Examiner*—Alexander Thomas

[57] ABSTRACT

A new stained glass window design for reducing costs associated with securing stained glass. The inventive device includes a frame member having a hollow interior. The frame member includes a matrix of criss-crossing members disposed within the hollow interior. The frame has an interior peripheral edge. A plurality of stained glass pieces are positioned atop of the criss-crossing members and along the interior peripheral edge of the frame member. A quantity of gypsum cement connects each of the stained glass pieces together and secure the stained glass pieces to the frame member.

2 Claims, 2 Drawing Sheets

FIG. 3
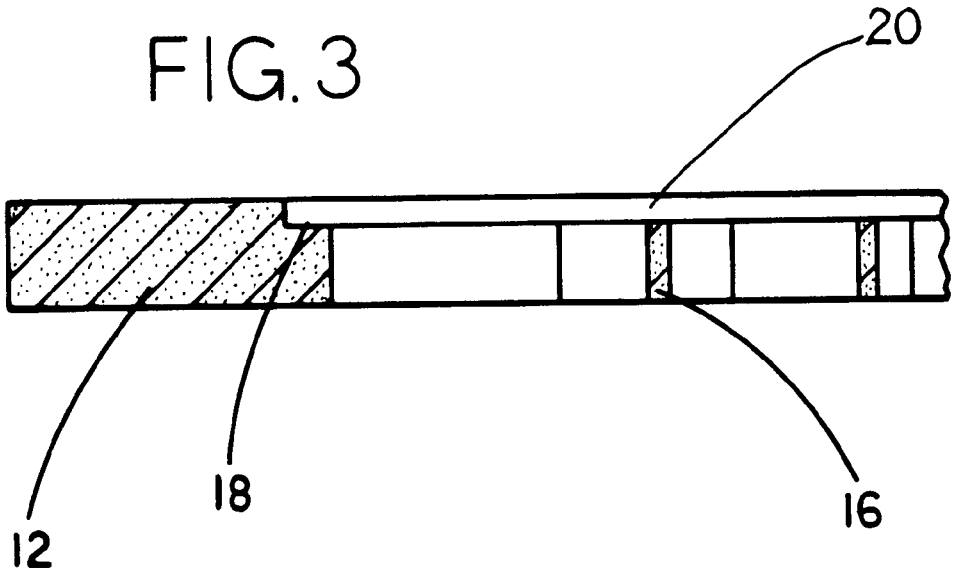
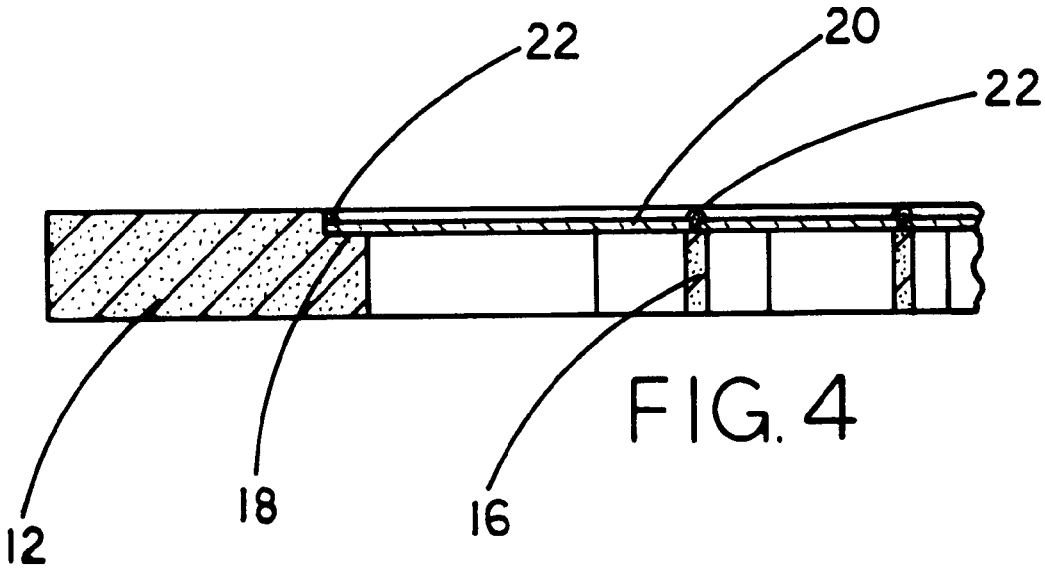
FIG. 4

STAINED GLASS WINDOW DESIGN

BACKGROUND OF THE INVENTION

1. Field of the Invention

The present invention relates to stained glass structures and more particularly pertains to a new stained glass window design for reducing costs associated with securing stained glass.

2. Description of the Prior Art

The use of stained glass structures is known in the prior art. More specifically, stained glass structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art stained glass structures include U.S. Pat. No. 4,302,260 to Melzer; U.S. Pat. No. 4,252,847 to DelGrande; U.S. Pat. No. 5,039,468 to Sellers; U.S. Pat. No. 4,016,235 to Ferro; U.S. Pat. No. 5,205,884 to Rauscher; and U.S. Pat. No. Des. 353,208 to Kozak.

While these devices fulfill their respective, particular objectives and requirements, the aforementioned patents do not disclose a new stained glass window design. The inventive device includes a frame member having a hollow interior. The frame member includes a matrix of criss-crossing members disposed within the hollow interior. The frame has an interior peripheral edge. A plurality of stained glass pieces are positioned atop of the criss-crossing members and along the interior peripheral edge of the frame member. A quantity of gypsum cement connects each of the stained glass pieces together and secure the stained glass pieces to the frame member.

In these respects, the stained glass window design according to the present invention substantially departs from the conventional concepts and designs of the prior art, and in so doing provides an apparatus primarily developed for the purpose of reducing costs associated with securing stained glass

SUMMARY OF THE INVENTION

In view of the foregoing disadvantages inherent in the known types of stained glass structures now present in the prior art, the present invention provides a new stained glass window design construction wherein the same can be utilized for reducing costs associated with securing stained glass.

The general purpose of the present invention, which will be described subsequently in greater detail, is to provide a new stained glass window design apparatus and method which has many of the advantages of the stained glass structures mentioned heretofore and many novel features that result in a new stained glass window design which is not anticipated, rendered obvious, suggested, or even implied by any of the prior art stained glass structures, either alone or in any combination thereof.

To attain this, the present invention generally comprises a circular frame member having a hollow interior. The frame member includes a matrix of criss-crossing members disposed within the hollow interior. The circular frame has an interior peripheral edge. A plurality of stained glass pieces are positioned atop of the criss-crossing members and along the interior peripheral edge of the circular frame member. A quantity of gypsum cement connects each of the stained glass pieces together and secure the stained glass pieces to the circular frame member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new stained glass window design apparatus and method which has many of the advantages of the stained glass structures mentioned heretofore and many novel features that result in a new stained glass window design which is not anticipated, rendered obvious, suggested, or even implied by any of the prior art stained glass structures, either alone or in any combination thereof.

It is another object of the present invention to provide a new stained glass window design which may be easily and efficiently manufactured and marketed.

It is a further object of the present invention to provide a new stained glass window design which is of a durable and reliable construction.

An even further object of the present invention is to provide a new stained glass window design which is susceptible of a low cost of manufacture with regard to both materials and labor, and which accordingly is then susceptible of low prices of sale to the consuming public, thereby making such stained glass window design economically available to the buying public.

Still yet another object of the present invention is to provide a new stained glass window design which provides in the apparatuses and methods of the prior art some of the advantages thereof, while simultaneously overcoming some of the disadvantages normally associated therewith.

Still another object of the present invention is to provide a new stained glass window design for reducing costs associated with securing stained glass.

Yet another object of the present invention is to provide a new stained glass window design which includes a frame member having a hollow interior. The frame member includes a matrix of criss-crossing members disposed within the hollow interior. The frame has an interior peripheral edge. A plurality of stained glass pieces are positioned atop of the criss-crossing members and along the interior peripheral edge of the frame member. A quantity of gypsum cement connects each of the stained glass pieces together and secure the stained glass pieces to the frame member.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross-sectional view of the present invention as taken along line 3—3 of FIG. 1.

FIG. 4 is a cross-sectional view of the present invention illustrated with gypsum cement in use.

DESCRIPTION OF THE PREFERRED EMBODIMENT

Figure 1:
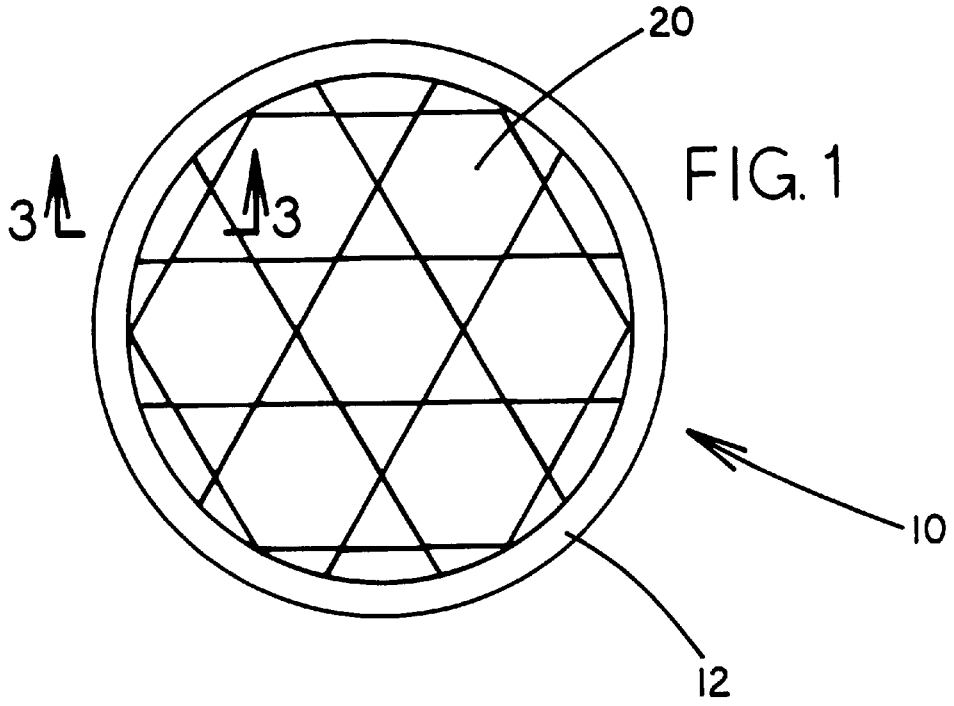
FIG. 1 is a plan view of a new stained glass window design according to the present invention.
Figure 2:
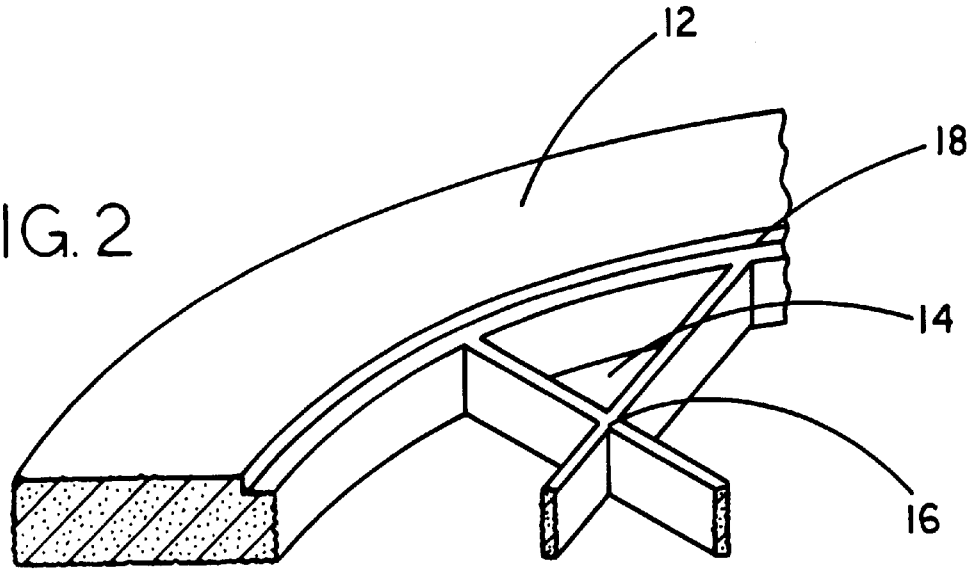
FIG. 2 is a perspective sectional view of the present invention.

With reference now to the drawings, and in particular to FIGS. 1 through 4 thereof, a new stained glass window design embodying the principles and concepts of the present invention and generally designated by the reference numeral 10 will be described.

As best illustrated in FIGS. 1 through 4, the stained glass window design 10 comprises a circular frame member 12 having a hollow interior 14. The frame member 12 includes a matrix of criss-crossing members 16 disposed within the hollow interior 14. The circular frame member 12 has an interior peripheral edge 18.

A plurality of stained glass pieces 20 are positioned atop of the criss-crossing members 16 and along the interior peripheral edge 18 of the circular frame member 12.

A quantity of gypsum cement 22 connects each of the stained glass pieces together and secure the stained glass pieces to the circular frame member.

In use, the present invention would make use of small sections of stained glass 20 of various colors that would arrange to form a geometric pattern or potentially some tape of illustration. The gypsum cement 22 would replace the traditional lead beading used to retain the glass pieces 20 together.

As to a further discussion of the tranner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new stained glass window design for reducing costs associated with securing stained glass comprising, in combination:

a circular frame member having a hollow interior, the frame member including a matrix of criss-crossing members disposed within the hollow interior, the circular frame member having an interior peripheral edge;

a plurality of stained glass pieces positioned atop of the criss-crossing members and along the interior peripheral edge of the circular frame member; and a quantity of gypsum cement connecting each of the stained glass pieces together and securing the stained glass pieces to the circular frame member.

2. A new stained glass window design for reducing costs associated with securing stained glass comprising, in combination:

a frame member having a hollow interior, the frame member including a matrix of criss-crossing members disposed within the hollow interior, the frame member having an interior peripheral edge;

a plurality of stained glass pieces positioned atop of the criss-crossing members and along the interior peripheral edge of the frame member; and a quantity of gypsum cement connecting each of the stained glass pieces together and securing the stained glass pieces to the frame member.

* * * * *